US009144279B2

(12) United States Patent
Venida et al.

(10) Patent No.: US 9,144,279 B2
(45) Date of Patent: Sep. 29, 2015

(54) RUGGED CASES FOR TABLETS

(71) Applicant: ACCO Brands Corporation, Lake Zurich, IL (US)

(72) Inventors: A. John Venida, San Francisco, CA (US); Will Ali, Vancouver (CA); Judy Barker, Menlo Park, CA (US); Wilson Tse, Burnaby (CA)

(73) Assignee: ACCO Brands Corporation, Lake Zurich, IL (US)

( * ) Notice: Subject to any disclaimer, the term of this patent is extended or adjusted under 35 U.S.C. 154(b) by 224 days.

(21) Appl. No.: 14/030,842

(22) Filed: Sep. 18, 2013

(65) Prior Publication Data

US 2015/0076188 A1 Mar. 19, 2015

(51) Int. Cl.
*B65D 85/00* (2006.01)
*A45C 11/00* (2006.01)

(52) U.S. Cl.
CPC ..... *A45C 11/00* (2013.01); *A45C 2011/003* (2013.01)

(58) Field of Classification Search
CPC combination set(s) only.
See application file for complete search history.

(56) References Cited

U.S. PATENT DOCUMENTS

| | | | | |
|---|---|---|---|---|
| 5,417,319 | A * | 5/1995 | Chalberg et al. | 206/1.5 |
| 6,772,879 | B1 * | 8/2004 | Domotor | 206/45.23 |
| 8,573,395 | B1 * | 11/2013 | Dafni et al. | 206/320 |
| 2003/0114206 | A1 * | 6/2003 | Timothy et al. | 455/575 |
| 2006/0044288 | A1 * | 3/2006 | Nakamura et al. | 345/179 |
| 2008/0031606 | A1 * | 2/2008 | Zax et al. | 396/56 |
| 2009/0128521 | A1 * | 5/2009 | Chen | 345/179 |
| 2010/0065454 | A1 * | 3/2010 | Badillo et al. | 206/320 |
| 2011/0061427 | A1 | 3/2011 | Mahaffey et al. | |
| 2012/0153116 | A1 * | 6/2012 | Harrison | 248/460 |
| 2012/0317779 | A1 | 12/2012 | Myers et al. | |
| 2012/0318711 | A1 | 12/2012 | Stacey et al. | |
| 2013/0056374 | A1 * | 3/2013 | Chung | 206/320 |
| 2014/0326638 | A1 * | 11/2014 | Webber | 206/764 |

* cited by examiner

*Primary Examiner* — Jacob K Ackun
(74) *Attorney, Agent, or Firm* — Michael Best & Friedrich LLP

(57) ABSTRACT

An apparatus for housing and displaying a portable electronic device includes a housing having a window sized to display a portion of a screen of a portable electronic device disposed within the housing. The apparatus also includes a first recess disposed in the housing, the first recess sized and configured to hold a stylus at a first angle relative to the housing. The apparatus also includes a second recess disposed in the housing, the second recess sized and configured to hold the stylus at a second, different angle relative to the housing.

13 Claims, 7 Drawing Sheets

RUGGED CASES FOR TABLETS

BACKGROUND

The present invention relates to rugged cases for holding portable electronic devices, and particularly for holding tablet portable electronic devices.

Cases for tablets such as the iPad® are known. These cases typically include a housing that receives the tablet, and a window in the housing that permits viewing of the screen on the tablet. The cases also include a handle for holding and transporting the case.

SUMMARY

In accordance with one construction, an apparatus for housing and displaying a portable electronic device includes a housing having a window sized to display a portion of a screen of a portable electronic device disposed within the housing. The apparatus also includes a first recess disposed in the housing, the first recess sized and configured to hold a stylus at a first angle relative to the housing. The apparatus also includes a second recess disposed in the housing, the second recess sized and configured to hold the stylus at a second, different angle relative to the housing.

In accordance with another construction, an apparatus for housing and displaying a portable electronic device includes a housing having a window along a front portion of the housing, the window sized to display a portion of a screen of a portable electronic device disposed within the housing. The apparatus also includes a recess disposed along a back portion of the housing to hold an end portion of a stylus at an angle relative to the housing to provide a stand for the housing.

In accordance with another construction, an apparatus for housing and displaying a portable electronic device includes an inner housing including a locking structure having a projection. The apparatus also includes an outer housing disposed over the inner housing, the outer housing having a window sized to display a portion of a screen of a portable electronic device disposed within the inner housing. The outer housing further includes an aperture that provides access to the locking structure.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
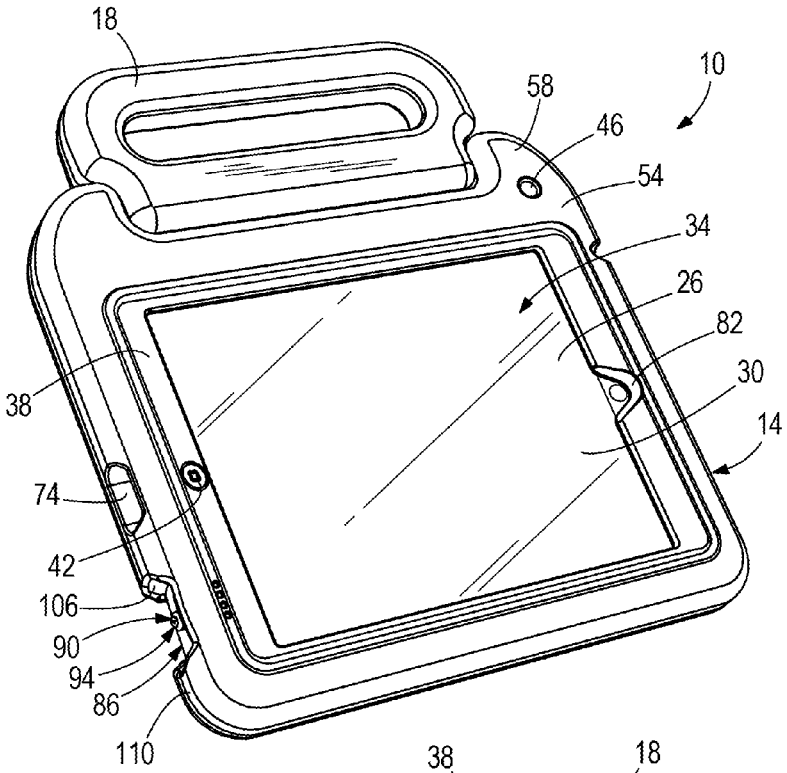
FIG. 1 is a front perspective view of a rugged case according to one construction of the invention.
Figure 2:
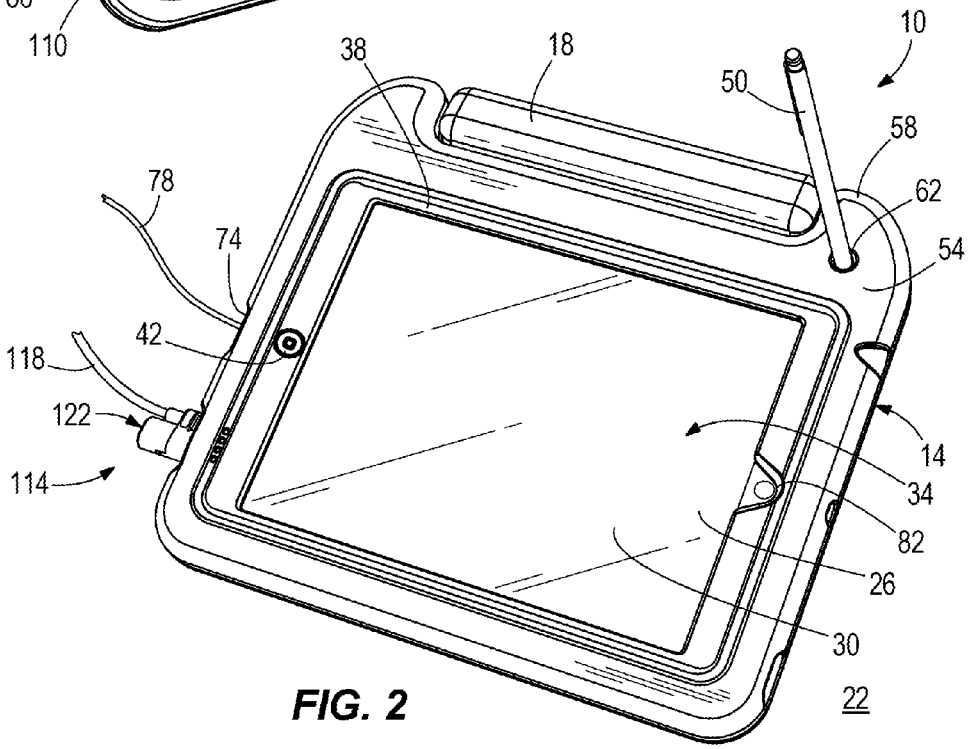
FIG. 2 is another front perspective view of the case of FIG. 1, further illustrating a stylus, power cord, and external lock coupled to the case.
Figure 3:
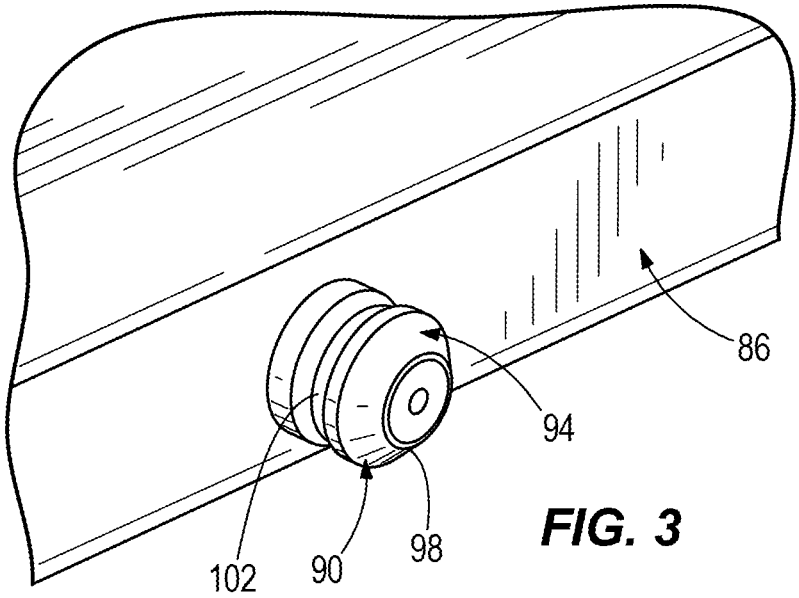
FIG. 3 is a partial perspective view of a locking structure on the case of FIG. 1.
Figure 4:
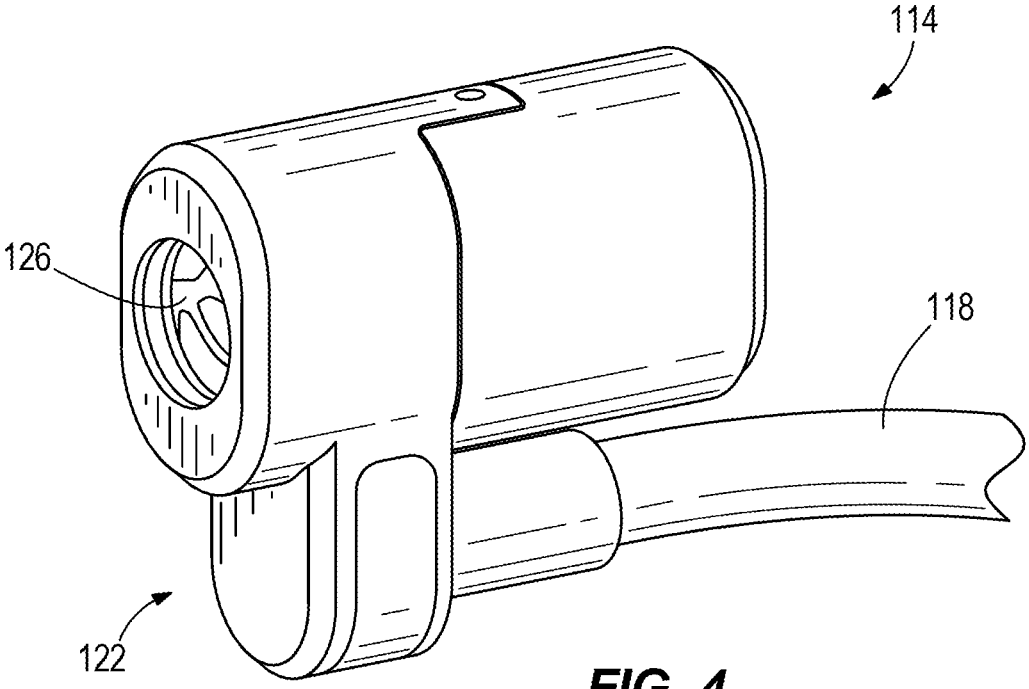
FIG. 4 is a perspective view of the external lock of FIG. 2.
Figure 5:
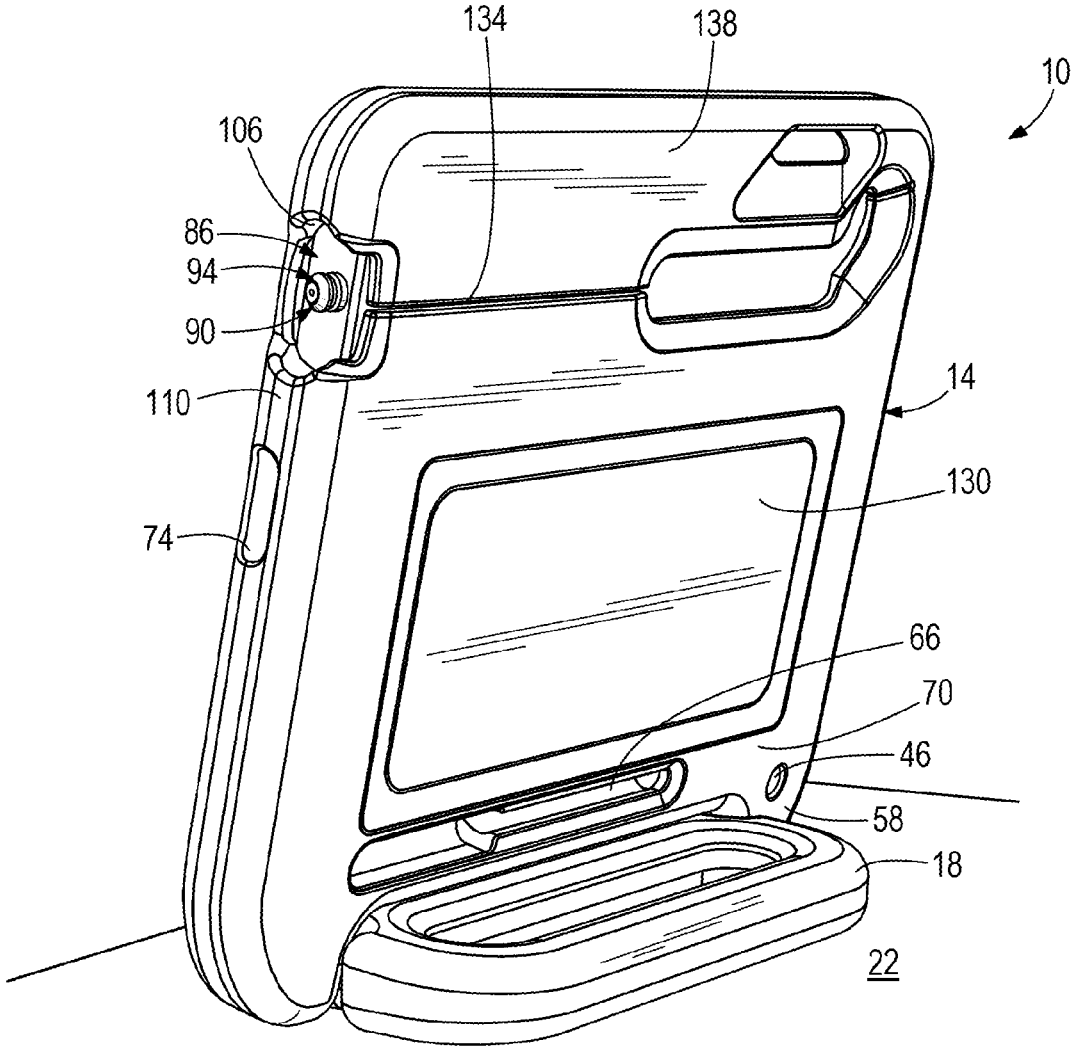
FIG. 5 is a rear perspective view of the case of FIG. 1.

FIGS. 1-5 illustrate a rugged case 10. The case 10 includes an outer housing 14, and a handle 18 pivotally coupled to the housing 14. The handle 18 is pivotal from a first position, as illustrated in FIG. 1, to a second position, as illustrated in FIGS. 2 and 5. The first and second positions are approximately 90 degrees apart, though in other constructions the first and second positions are greater than 90 degrees apart, or less than 90 degrees apart.

The first position of the handle 18 allows a user to hold and carry the case 10, as well as set the case 10 down flat on a generally flat surface 22, whereas the second position of the handle 18 provides both a low viewing angle (as illustrated in FIG. 2) and a high viewing angle (as illustrated in FIG. 5) when the case 10 is set down on the surface 22. The low viewing angle raises the case 10 less than approximately 45 degrees above the surface 22, and the high viewing angle raises the case 10 greater than or equal to approximately 45 degrees above the surface 22. In some constructions the high viewing angle is between approximately 70 degrees and 75 degrees relative to the surface 22.

With reference to FIGS. 1, 2, and 5, the housing 14 includes a window 26 sized to display at least a portion of a display screen 30 of a portable electronic device 34 (e.g., a tablet such as an iPad®) disposed within the housing 14. The housing 14 includes a border portion 38 extending around and defining a boundary of the window 26. The border portion 38 is sized and configured to fit over and cover a portion of the front of the portable electronic device 34. In particular, the border portion 38 is sized and configured to cover a home button on the front of the portable electronic device 34 directly below the display screen 30. The border portion 38 includes a symbol 42 formed into the border portion 38 that resembles the home button beneath it to enable the user to locate and press the home button. Overall, the border portion 38 provides increased protection for the portable electronic device 34.

With reference to FIGS. 1 and 2, the housing 14 also includes a recess 46 disposed in the housing. The recess 46 is sized and configured to hold a stylus 50 (illustrated in FIG. 2) at an angle relative to the housing 14. The recess 46 is a hole extending generally perpendicular to a front, outer surface 54 of the housing 14, such that the angle of the stylus 50 is generally perpendicular relative to the front surface 54. The recess 46 is located generally in a corner 58 of the housing 14. An end portion 62 of the stylus 50 fits snugly within and is received by the recess 46, and is held via a friction fit inside the recess 46. Other constructions of the housing 14 include different sizes, orientations, and locations for the recess 46.

With reference to FIG. 5, the housing 14 includes another recess 66 disposed in the housing 14, the recess 66 sized and configured to hold the stylus 50 at a second, different angle relative to the housing 14 than the recess 46. The illustrated recess 66 is disposed along a back surface 70 of the housing 14. The recess 66 is an elongate recess that is sized and configured to receive substantially an entire length of the stylus 50. While in the recess 66, the stylus 50 extends generally parallel to the back, outer surface 70.

As illustrated in FIG. 5, the recess 46 from the front surface 54 extends through to the back surface 70, thereby forming a through-hole, whereas the recess 66 forms an indentation. The stylus 50 may be inserted either on the front surface 54 at an angle generally perpendicular to the front surface 54 (in recess 46), on the back surface 70 at an angle generally perpendicular to the back surface 70 (in recess 46), or on the back surface 70 at an angle generally parallel to the back surface 70 (in recess 66). While not illustrated, in some constructions the housing 14 includes a recess on the front surface similar to recess 66, such that the stylus 50 may be inserted on the front surface 54 at an angle generally parallel to the front surface 54. In yet other constructions, one or more of the recesses 46 and 66 are formed along top, bottom, or side surfaces of the housing 14, rather than along the front or back surfaces 54, 70.

With reference to FIGS. 1 and 2, the housing 14 further includes an aperture 74 sized and configured to provide access for a charger 78 to reach a charging and data port (not shown) on the portable electronic device 34, as well as an aperture 82 sized and configured to provide viewing access for a camera (not shown) on the portable electronic device 34.

The case 10 is ideally suited for use in educational environments, as it provides protection for the portable electronic device 34 in the event the portable electronic device 34 is dropped, thrown, etc. by a student. The housing 14 is made of a padded material, and more specifically ethylene vinyl acetate, although other constructions include different materials or combinations of materials.

With continued reference to FIGS. 1-5, the case 10 is also configured to provide security protection for the portable electronic device 34 in the education setting or elsewhere. In particular, the case 10 includes an inner housing 86 disposed within the outer housing 14. U.S. Patent Publication No. 2012/0317779 and U.S. Patent Publication No. 2012/0318711, the entire contents of each of which are herein incorporated by reference, disclose examples of the inner housing 86.

The housing 86 is not coupled to the housing 14, although in other constructions the housing 86 is coupled to (e.g., integrally formed with) the outer housing 14. The inner housing 86 holds the portable electronic device 34, and includes a locking structure 90. The locking structure 90 includes a projection 94. As illustrated in FIG. 3, the projection 94 includes an outer ring structure 98 and a recessed area 102 behind the outer ring structure. Further description of the locking structure 90 can be found in U.S. Patent Publication No. 2011/0061427, the entire contents of which are herein incorporated by reference.

With reference to FIGS. 1 and 5, the outer housing 14 includes an aperture 106 that provides access to the locking structure 90 and the projection 94. The projection 94 does not extend past an outer side surface 110 of the outer housing 14, such that the projection 94 is recessed and partially hidden behind the outer side surface 110.

With reference to FIGS. 2 and 4, an external lock 114 is sized and configured to be releasably coupled to the locking structure 90. U.S. Patent Publication No. 2011/0061427, the entire contents of which are herein incorporated by reference, discloses examples of the external lock 114. The external lock 114 includes a security cable 118, as well as a lock housing 122 having an opening 126 to receive the projection 94. The security cable is sized and configured to attach to a stationary object (e.g., a desk), and the lock housing 122 is sized and configured to lock onto (e.g., snap on) the outer ring structure 98 and the recessed area 102 of the projection 94 to securely attach the external lock 114 to the locking structure 90. With the external lock attached, the case 10 is unable to be removed from the area of the stationary object. The case 10 is only able to be moved as far as the security cable 118 will allow it, thereby preventing theft of the portable electronic device 34.

With reference to FIG. 5, the housing 14 also includes a dedicated personalization region 130. The personalization region 130 is recessed along a back of the housing 14, although in other constructions the personalization region 130 is disposed along a front, or along one of the sides, of the housing 14. The personalization region 130 provides an area to write a user's name and/or affix a label that includes the user's name. The personalization region 130 is made of dry erase board material, clear plastic, or other suitable material.

With continued reference to FIG. 5, the housing 14 includes a parting line 134 along the back of the housing 14. The parting line 134 allows a top portion 138 of the housing 14 to be flipped or bent back relative to the rest of the housing 14 to facilitate insertion of the portable electronic device 34 and the inner housing 86 into the housing 14.

Figure 7:
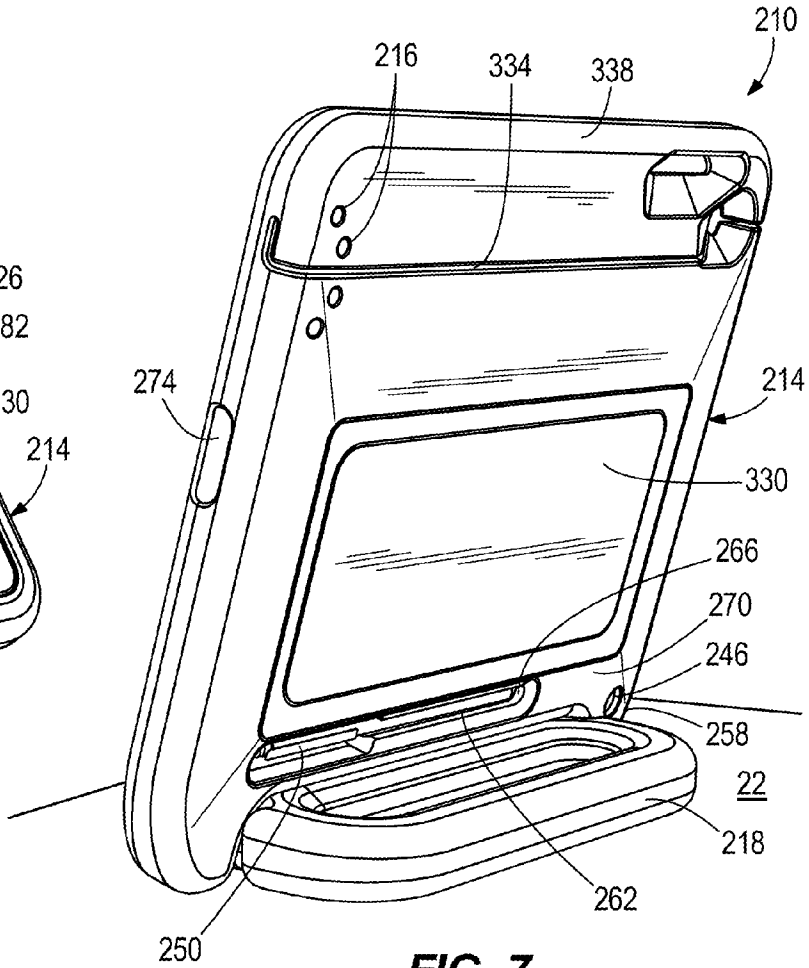
FIG. 7 is a rear perspective view of the case of FIG. 6.
Figure 6:
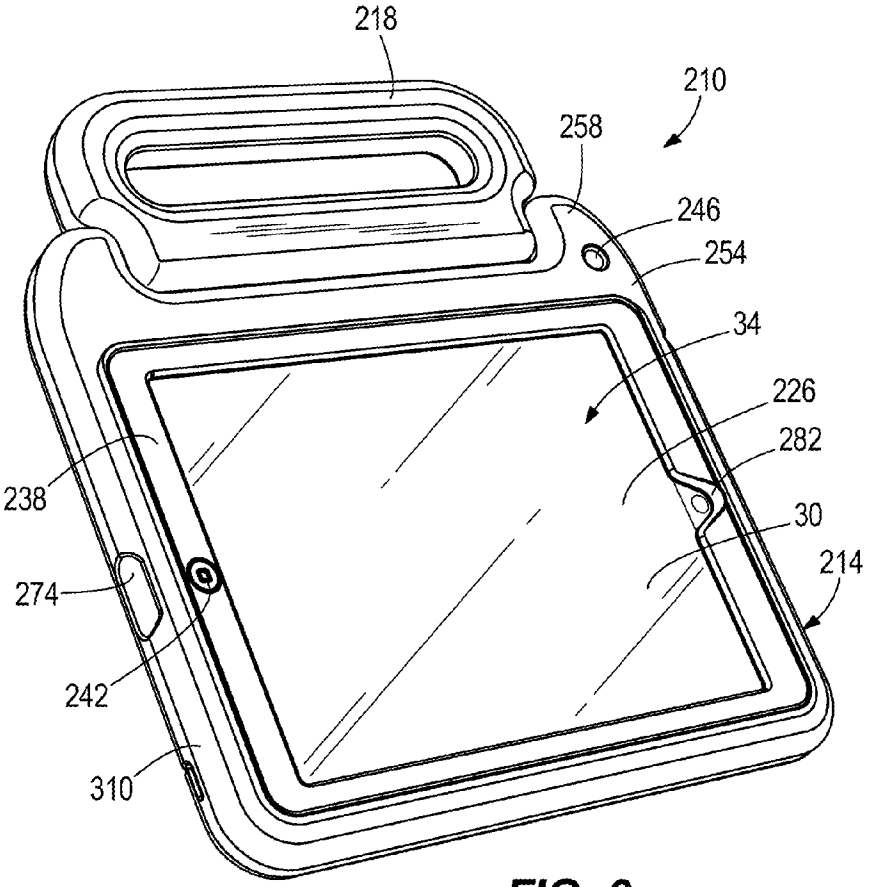
FIG. 6 is a front perspective view of a rugged case according to another construction of the invention.

FIGS. 6 and 7 illustrate another rugged case 210. The case 210 is similar to the case 10, and includes like numerical references for similar components. While smaller than case 10, the case 210 is also sized and configured to hold the same portable electronic device 34.

The case 210 includes a handle 218 pivotally coupled to the outer housing 214. The handle 218 is pivotal from a first position, as illustrated in FIG. 6, to a second position, as illustrated in FIG. 7. The first and second positions are approximately 90 degrees apart, though in other constructions the first and second positions are greater than 90 degrees apart, or less than 90 degrees apart.

The first position of the handle 218 allows a user to hold and carry the case 210, as well as set the case 210 down flat on the generally flat surface 22, whereas the second position of the handle 218 provides both a low viewing angle (similar to FIG. 2) and a high viewing angle (as illustrated in FIG. 7) when the case 210 is set down on the surface 22. The low viewing angle raises the case 210 less than approximately 45 degrees above the surface 22, and the high viewing angle raises the case 210 greater than or equal to approximately 45 degrees above the surface 22. In some constructions the high viewing angle is between approximately 70 degrees and 75 degrees relative to the surface 22.

The outer housing 214 includes a window 226 sized to display at least a portion of the display screen 30 of the portable electronic device 34 disposed within the housing 214. The housing 214 includes a border portion 238 extending around and defining the boundary of the window 226, the border portion 238 sized and configured to fit over and cover a portion of the front of the portable electronic device 34. In particular, the border portion 38 is sized and configured to cover a home button on the portable electronic device 34 located directly below the display screen 30. The border portion 238 includes a symbol 242 etched into the border portion 238 that resembles the home button beneath it to enable the user to locate and press the home button. Overall, the border portion 238 provides increased protection for the portable electronic device 34.

With continued reference to FIGS. 6 and 7, the outer housing 214 includes a recess 246 disposed in the housing, the recess 246 sized and configured to hold a stylus 250 (as illustrated in FIG. 7) at an angle relative to the housing 214. The recess 246 is a hole extending generally perpendicular to a front, outer surface 254 of the housing 214, such that the angle of the stylus 250 is generally perpendicular relative to the front surface 254. The recess 246 is located generally in a corner 258 of the housing 214. An end portion 262 of the stylus 250 fits snugly within and is received by the recess 246, and is held via a friction fit inside the recess 246. Other constructions of the housing 214 include different sizes, orientations, and locations for the recess 246.

The housing 214 also includes another recess 266 disposed in the housing 214, the recess 266 sized and configured to hold the stylus 250 at a second, different angle relative to the housing 214 than the recess 246. The recess 266 is disposed along a back surface 270 of the housing 214. The recess 266 is an elongate recess that is sized and configured to receive substantially an entire length of the stylus 250. While in the recess 266, the stylus 250 extends generally parallel to the back, outer surface 270.

As illustrated in FIG. 7, the recess 246 from the front surface 254 extends through to the back surface 270, thereby forming a through-hole, whereas the recess 266 forms an indentation. The stylus 250 may be inserted either on the front surface 254 at an angle generally perpendicular to the front surface 254 (in the recess 246), on the back surface 270 at an angle generally perpendicular to the back surface 270 (in the recess 246), or on the back surface 270 at an angle generally parallel to the back surface 270 (in the recess 266). While not illustrated, in some constructions the housing 214 includes a recess on the front surface similar to recess 266, such that the stylus 250 may be inserted on the front surface 254 at an angle generally parallel to the front surface 254. In yet other constructions, one or more of the recesses 246 and 266 are formed along top, bottom, or side surfaces of the housing 214, rather than along the front or back surfaces 254, 270.

With continued reference to FIGS. 6 and 7, the housing 214 further includes an aperture 274 sized and configured to provide access for a charger (not shown) to reach a charging and data port (not shown) on the portable electronic device 34, as well as an aperture 282 sized and configured to provide viewing access for a camera (not shown) on the portable electronic device 34.

The case 210 does not include the inner housing 86, the locking structure 90, and the aperture 106 of case 10. Because the case 210 does not include the inner housing 86 and locking structure 90, the case 210 is slightly smaller in size than the case 10. However, as noted above, both the case 10 and the case 210 are sized and configured to hold the same portable electronic device 34.

With reference to FIG. 7, the case 210 also includes speaker perforations 216 located along the back surface 270. While the speaker perforations 216 are illustrated only on case 210, in some constructions the case 10 also includes speaker perforations. Additionally, while the speaker perforations 216 are illustrated on a back surface 270, in some constructions the speaker perforations are disposed along a front, side, top, or bottom surface of the case 10 or 210.

With continued reference to FIG. 7, the housing 214 includes a parting line 334 along the back of the housing 214. The parting line 334 allows a top portion 338 of the housing 214 to be flipped or bent back relative to the rest of the housing 214 (e.g., by creating a living hinge) to facilitate insertion of the portable electronic device 34 into the housing 214.

Figure 8:
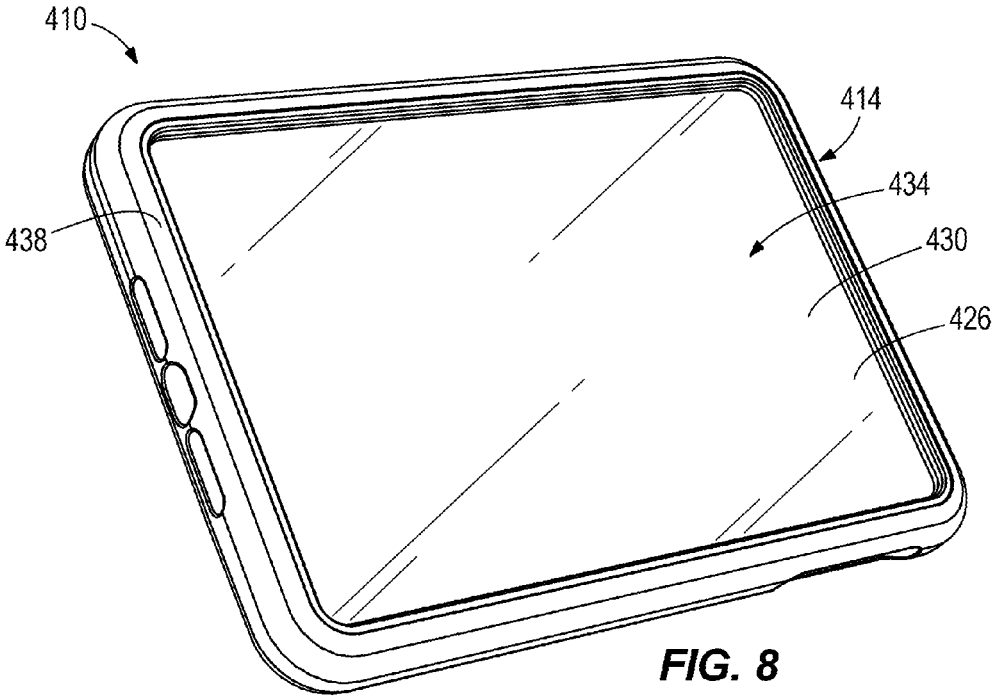
FIG. 8 is a front perspective view of a rugged case according to another construction of the invention.
Figure 9:
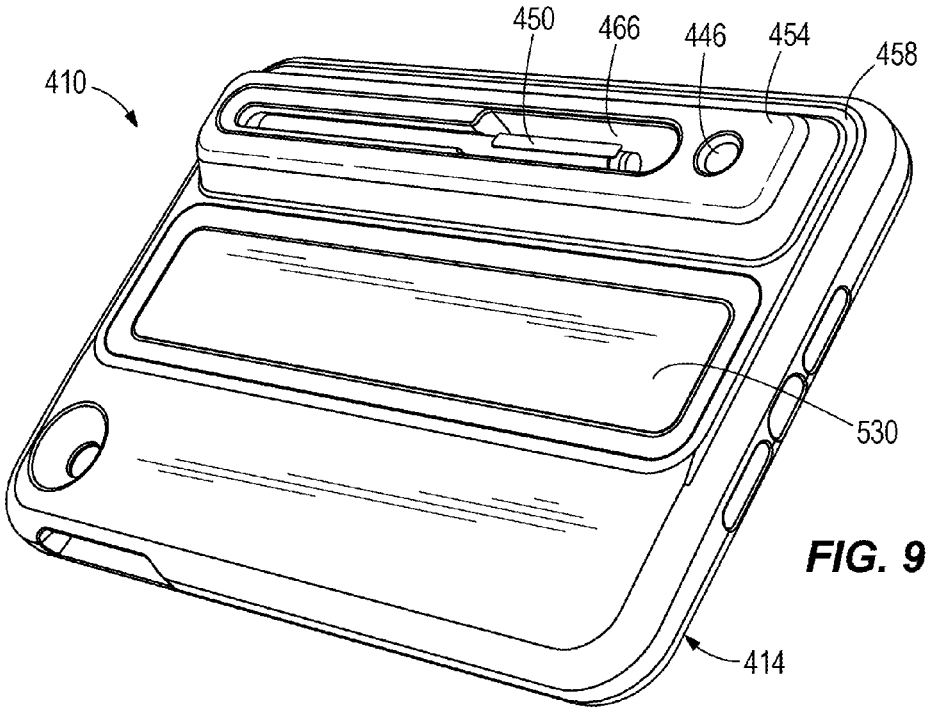
FIG. 9 is a rear perspective view of the case of FIG. 8, illustrating a stylus coupled to the case in a first orientation.
Figure 10:
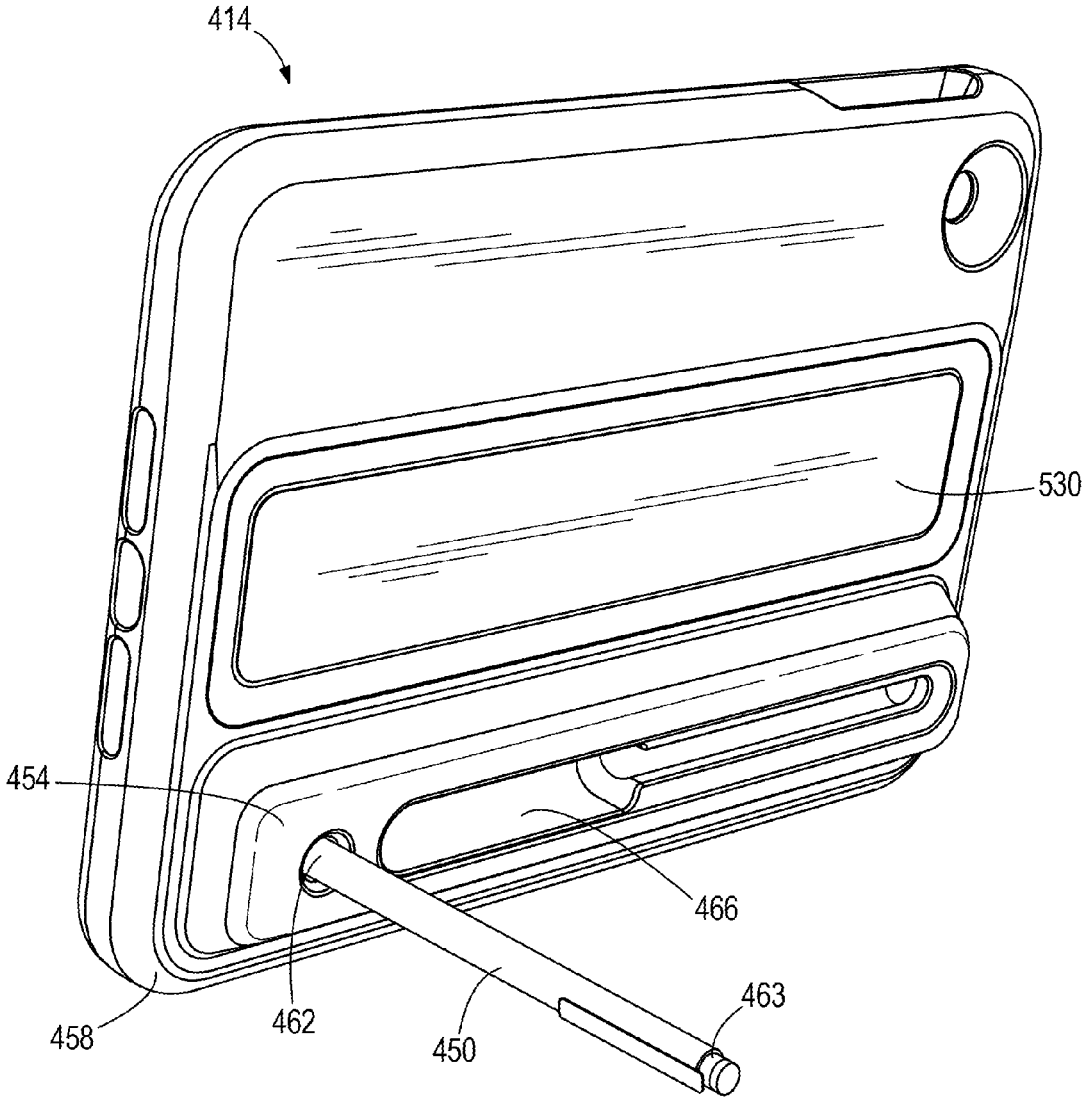
FIG. 10 is another rear perspective view of the case of FIG. 8, illustrating a stylus coupled to the case in a second orientation.

FIGS. 8-10 illustrate yet another rugged case 410. The case 410 is significantly smaller than the cases 10 and 210, and is sized and configured to hold a smaller portable electronic device than the portable electronic device 34 illustrated in FIGS. 1-7.

With reference to FIG. 8, the case 410 includes an outer housing 414 having a window 426 sized to display at least a portion of a display screen 430 of a portable electronic device 434 (e.g., the miniature version of the iPad®) disposed within the housing 414. The housing 414 includes a border portion 438 extending around and defining the boundary of the window 426, the border portion 438 sized and configured to fit over and cover a portion of the front of the portable electronic device 434. In particular, the border portion 438 is sized and configured to cover a home button on the portable electronic device 434 located directly below the display screen 430. As with the border portions 38 and 238, the border portion 438 also provides increased protection for the portable electronic device 434.

With continued reference to FIGS. 9 and 10, the outer housing 414 includes a recess 446 disposed in the housing, the recess 446 sized and configured to hold a stylus 450 at an angle relative to the housing 414. The recess 446 is a hole extending generally perpendicular to a back, outer surface 454 of the housing 414, such that the angle of the stylus 450 is generally perpendicular relative to the back surface 454. The recess 446 is located generally in a corner 458 of the housing 414. As illustrated in FIG. 10, an end portion 462 of the stylus 450 fits snugly within and is received by the recess 446, and is held via a friction fit inside the recess 446. Other constructions of the housing 414 include different sizes, orientations, and locations for the recess 446.

The housing 414 also includes another recess 466 disposed in the housing 414. The recess 466 is sized and configured to hold the stylus 450 at a second, different angle relative to the housing 414 than the recess 446. The recess 466 is also disposed along the back, outer surface 454 of the housing 414. The recess 466 is an elongate recess that is sized and configured to receive substantially an entire length of the stylus 450. While in the recess 466, the stylus 450 extends generally parallel to the back, outer surface 454.

With reference to FIG. 10, when the stylus 450 is disposed in the recess 446, the stylus 450 provides a high-angle stand for the housing 414 and supports the housing 414. In this position, the housing 414 is supported both at the end portion 462 of the stylus, as well as by another, opposite end portion 463 of the stylus 450 that rests along the surface 22. As illustrated in FIG. 10, the stylus 450 supports and raises the case 410 greater than or equal to approximately 45 degrees above the surface 22 to provide a high viewing angle. In some constructions the high viewing angle is between approximately 70 degrees and 75 degrees relative to the surface 22.

With continued reference to FIG. 10, the housing 414 also includes a dedicated personalization region 530. As with the personalization regions 130 and 330, the personalization region 530 is also recessed along a back of the housing 514. The personalization region 530 provides an area to write a user's name and/or affix a label that includes the user's name. The personalization region 530 may be made of dry erase board material, clear plastic, or other suitable material.

Figure 12:
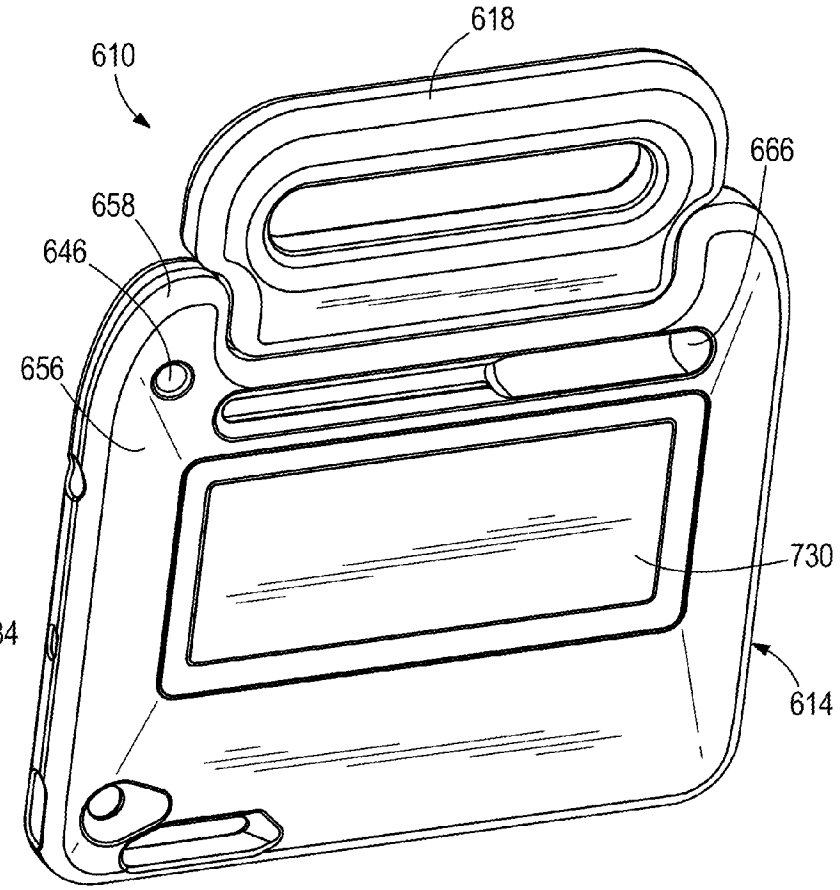
FIG. 12 is a rear perspective view of the case of FIG. 11.
Figure 11:
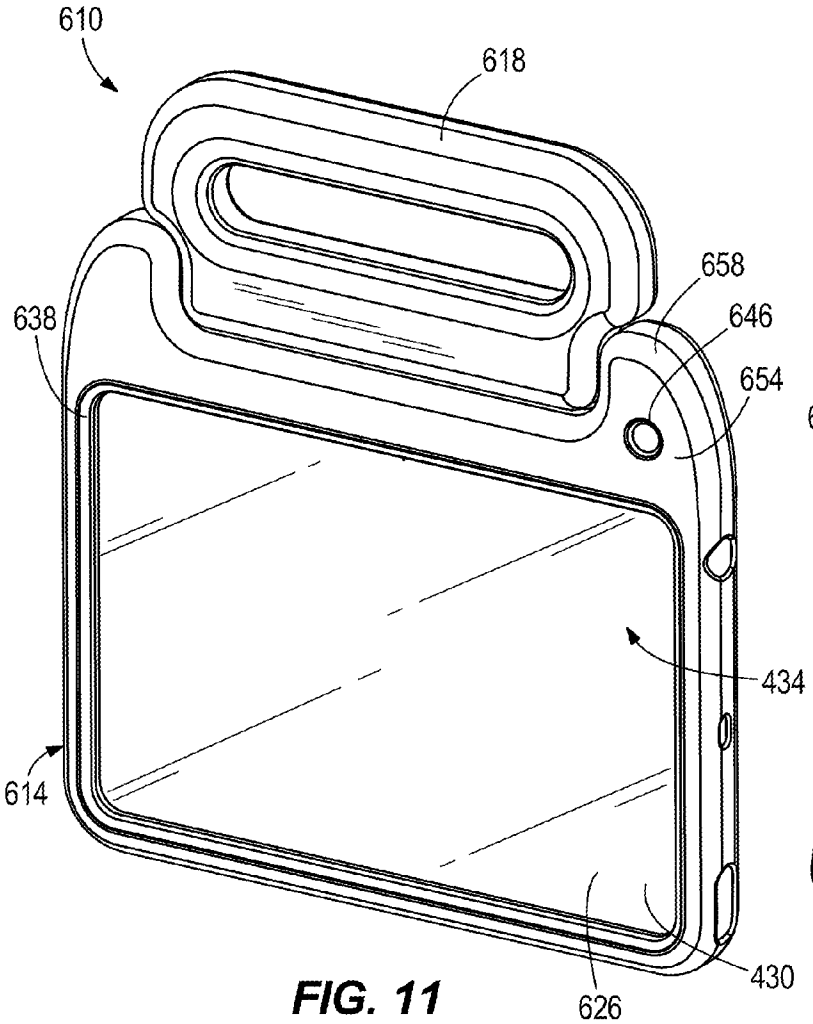
FIG. 11 is a front perspective view of a rugged case according to another construction of the invention.

FIGS. 11 and 12 illustrate yet another rugged case 610. The case 610 is similar to the case 410, and includes like numerical references for similar components. Both the case 410 and the case 610 are sized and configured to hold the same, smaller portable electronic device 434.

The case 610 includes a handle 618 pivotally coupled to an outer housing 614. The handle 618 is pivotal from a first position, as illustrated in FIGS. 11 and 12, to a second position approximately 90 degrees apart from the first position (similar to FIGS. 2 and 5), though in other constructions the first and second positions are greater than, or less than, 90 degrees apart.

As with the handles 18 and 218, the first position of the handle 618 also allows a user to hold and carry the case 610, as well as set the case 610 down flat on the generally flat surface 22, whereas the second position of the handle 618 provides both a low viewing angle and a high viewing angle (similar to FIGS. 2 and 5) when the case 610 is set down on the surface 22. The low viewing angle raises the case 610 less than approximately 45 degrees above the surface 22, and the high viewing angle raises the case 610 greater than or equal to approximately 45 degrees above the surface 22. In some constructions the high viewing angle is between approximately 70 degrees and 75 degrees relative to the surface 22.

With continued reference to FIG. 11, the outer housing 614 includes a window 626 sized to display at least a portion of the display screen 430 of the portable electronic device 434 (e.g., the miniature version of the iPad®) disposed within the housing 614. The housing 614 includes a border portion 638 extending around and defining the boundary of the window 626, the border portion 638 sized and configured to fit over and cover a portion of the front of the portable electronic device 434. In some constructions the border portion 638 includes a symbol, similar to symbols 42, 242, 442, etched into the border portion 638 that resembles a home button beneath it to enable the user to locate and press the home button. As with the border portions 38, 238, and 438, the border portion 638 also provides increased protection for the portable electronic device 634.

With continued reference to FIGS. 11 and 12, the outer housing 614 also includes a recess 646 disposed in the housing that extends through the housing 614. The recess 646 is sized and configured to hold a stylus (not shown) at an angle relative to the housing 614. The recess 646 is a hole extending generally perpendicular to both a front, outer surface 654 of the housing 614 and a back, outer surface 656 of the housing 614, such that the angle of the stylus is generally perpendicular relative to the front and back surfaces 654, 656. The recess 646 is located generally in a corner 658 of the housing 614. An end portion of the stylus fits snugly within and is received by the recess 646, and is held via a friction fit inside the recess 646. Other constructions of the housing 614 include different sizes, orientations, and locations for the recess 646.

As with the case 410, the housing 614 of the case 610 also includes another recess 666 disposed in the housing 614, the recess 666 sized and configured to hold the stylus at a second, different angle relative to the housing 614 than the recess 546. The recess 666 is disposed along the back, outer surface 656 of the housing 614. The recess 666 is an elongate recess that is sized and configured to receive substantially an entire length of the stylus. While in the recess 666, the stylus extends generally parallel to the back, outer surface 656.

When the stylus is disposed in the recess 646 of the housing 614, the stylus provides a high-angled stand for the housing 614 and supports the housing 614, similar to stylus 450 in FIG. 10. In this position, the housing 614 is supported by two opposite ends of the stylus, one end positioned in the recess 646 and the other end lying on the surface 22.

With continued reference to FIG. 12, the housing 614 also includes a dedicated personalization region 730. As with the personalization regions 130, 330, and 530, the personalization region 730 is recessed along a back of the housing 614. The personalization region 730 provides an area to write a user's name and/or affix a label that includes the user's name. The personalization region 730 is made of dry erase board material, clear plastic, or other suitable material.

While not illustrated, in some constructions the case 410 and/or the case 610 also includes an inner housing and locking structure, similar to inner housing 86 and locking structure 90 described above for case 10. In some constructions the case 410 and/or the case 610 includes speaker perforations similar to the speaker perforations 216 described above for case 210. Additionally, in some constructions the case 410 and/or the case 610 includes a parting line similar to the parting lines 134 and 334.

Various features and advantages of the invention are set forth in the following claims.

The invention claimed is:

1. An apparatus for housing and displaying a portable electronic device comprising:

a housing having a window sized to display at least a portion of a display screen of a portable electronic device disposed within the housing;

a first recess disposed in the housing, the first recess sized and configured to hold a stylus at a first angle relative to the housing; and a second recess disposed in the housing, the second recess sized and configured to hold the stylus at a second, different angle relative to the housing.

2. The apparatus of claim 1, wherein the first recess is an elongate recess that is sized and configured to receive substantially an entire length of the stylus, and wherein the second recess is sized and configured to receive only an end portion of the stylus.

3. The apparatus of claim 1, wherein the first angle is generally parallel to an outer surface of the housing, and the second angle is generally perpendicular to the outer surface of the housing.

4. The apparatus of claim 1, wherein the first recess is on a front portion of the housing, and the second recess is on a back portion of the housing.

5. The apparatus of claim 1, wherein both the first recess and the second recess are on a back portion of the housing.

6. The apparatus of claim 5, wherein the apparatus further includes a stylus sized to fit in the second recess such that the stylus is a supporting high-angle stand for the housing.

7. The apparatus of claim 1, further including a locking structure coupled to the housing and having a projection to receive an external lock.

8. An apparatus for housing and displaying a portable electronic device comprising:

an inner housing including a locking structure having a projection; and an outer housing disposed over the inner housing, the outer housing having a window sized to display at least portion of a display screen of a portable electronic device disposed within the inner housing, the outer housing further including an aperture that provides access to the locking structure.

9. The apparatus of claim 8, wherein the locking structure includes a ring structure and a recessed area to receive an external lock.

10. The apparatus of claim 8, wherein the outer housing includes a recessed, dedicated personalization region having at least one of an area to write and affix a label.

11. The apparatus of claim 8, further including an external lock that couples to the locking structure, the external lock including a security cable.

12. The apparatus of claim 8, wherein the outer housing includes an outer surface, and the locking structure is recessed inwardly from the outer surface.

13. The apparatus of claim 8, wherein the outer housing includes two separate recesses each sized and configured to receive at least a portion of a stylus.

* * * * *